US007028420B2

(12) United States Patent
Tonkel

(10) Patent No.: US 7,028,420 B2
(45) Date of Patent: Apr. 18, 2006

(54) SHOE OR SANDAL HAVING ROTATABLE AND REVERSIBLE VAMP, OR LOOP STRAP

(75) Inventor: Raymond F. Tonkel, Sudbury, MA (US)

(73) Assignee: U-Turn Sports Co. LLC (Mo. Corp), Wildwood, MO (US)

( * ) Notice: Subject to any disclaimer, the term of this patent is extended or adjusted under 35 U.S.C. 154(b) by 0 days.

(21) Appl. No.: 10/720,317

(22) Filed: Nov. 24, 2003

(65) Prior Publication Data

US 2004/0118016 A1 Jun. 24, 2004

Related U.S. Application Data

(60) Provisional application No. 60/442,817, filed on Jan. 28, 2003, provisional application No. 60/430,967, filed on Dec. 4, 2002.

(51) Int. Cl.
*A43B 3/12* (2006.01)
*A43B 3/24* (2006.01)

(52) U.S. Cl. ..... 36/100; 36/11.5

(58) Field of Classification Search ..... 36/15, 36/100, 101, 11.5
See application file for complete search history.

(56) References Cited

U.S. PATENT DOCUMENTS 1,976,819 A 10/1934 Weiler
2,343,701 A * 3/1944 Pickens ..... 36/11.5
2,539,761 A 1/1951 Whitman
2,948,070 A 8/1960 Lewis
3,204,346 A 9/1965 Lockard et al.
3,228,124 A * 1/1966 Schwarz ..... 36/11.5
3,455,037 A * 7/1969 Vlas et al. ..... 36/11.5
4,296,558 A 10/1981 Antonious
4,300,294 A * 11/1981 Riecken ..... 36/97
4,314,412 A 2/1982 Anderson et al.
4,476,639 A 10/1984 Zaccaria
4,550,511 A 11/1985 Gamm
4,860,464 A 8/1989 Misevich et al.
4,967,750 A * 11/1990 Cherniak ..... 36/140
5,353,483 A 10/1994 Louviere (Continued)

FOREIGN PATENT DOCUMENTS

GB 2071481 * 9/1981

*Primary Examiner*—M. D. Patterson
(74) *Attorney, Agent, or Firm*—Paul M. Denk

(57) ABSTRACT

A shoe, sandal, beach shoe, or other form of footwear, integrates a slot within its sole structure, as this footwear is assembled, and within the slot is a continuous band, that may form part of the shoe vamp, strapping, or related structure, and which vamp or band may be turned, for displaying different coloration or designs, texture, or means for providing support, massaging, or stimulation, of the foot, as through interiorly protruding tips, or to form and dispose apertures that furnish ventilation and aeration to the foot thereunder, all in order to change the aesthetics of the footwear at the desire of the user. In addition, to add to the structural integrity of the constructed shoes, a part of the vamp or its strapping, may extend upwardly, and have a loop formed therein, or even loop back on itself, and which may embrace the upper part of the changeable vamp, to facilitate its retention, and structural configuration, when the vamp is turned, to vary its appearance.

5 Claims, 17 Drawing Sheets

U.S. PATENT DOCUMENTS 5,379,529 A 1/1995 Smith et al.
6,128,834 A * 10/2000 Vecchiola et al. ..... 36/11.5
6,499,234 B1 * 12/2002 Manzi ..... 36/100
6,543,157 B1 * 4/2003 Pan ..... 36/11.5
6,601,323 B1 8/2003 Tsujino et al.
6,606,803 B1 8/2003 Ritter et al.
6,792,696 B1 9/2004 Berg et al.
2002/0078600 A1 * 6/2002 Berg et al. ..... 36/101
2002/0100189 A1 8/2002 Manzi
2002/0124433 A1 * 9/2002 Pan ..... 36/11.5
2003/0074806 A1 * 4/2003 Urie et al. ..... 36/11.5

* cited by examiner

SHOE OR SANDAL HAVING ROTATABLE AND REVERSIBLE VAMP, OR LOOP STRAP

CROSS REFERENCE TO REALTED APPLICATION

This non provisional patent application claims priority to the provisional patent application having Ser. No. 60/430,967, which was filed on Dec. 4, 2002, and provisional patent application having Ser. No. 60/442,817, which was filed on Jan. 28, 2003.

BACKGROUND OF THE INVENTION

This invention relates generally to a turnable vamp for a sandal, slider, clog, or other type of footwear, wherein the coloration or design for the footwear may be drastically changed simply through revolving of a turnable component that is integrally but slidably formed into or on top of the structure of the footwear.

Various types of designs have long been available in the prior art, to add further decorativeness to the structure of footwear. For example, the shoes to Lewis, in U.S. Pat. No. 2,948,070, shows a high-heeled type of shoe, as can be noted, with a vamp stitched to the upper surface of the sole. The vamp has a pair of J shaped guides or folds, at its front and back edges, and which can accept a supplementary surface or vamp therein. This particular supplementary vamp is the type that can be removed, and replaced, for fashion purposes, to add different coloration, designs, or the like, to the shown shoes.

The patent to Lockard, et al., U.S. Pat. No. 3,204,346, shows another type of interchangeable sole and upper for shoes. As can be noted, the sole has some tracks provided thereon, arcuately along the sides of the front of the upper part of the sole. Then, the shoe upper or vamp can be slid into these tracks, to provide different types of vamps for the shoe.

The patent to Anderson, et al., U.S. Pat. No. 4,314,412, shows an orthopedic shoe, wherein the shoe has a sole, as noted, with a slot therein, and through which the arch or orthopedic portion can insert.

There are published applications that relate to the subject matter of this current invention. For example, the patent to Manzi, Publication No. US2002/0100189A1, shows a shoe system, wherein a series of straps provide for retention of the foot to the platform shoe, as shown. As can be noted, the straps locate through slots provided within the sole, and then extend upwardly and cross and wrap around the back part of the sole, for retention purposes. These slots, in Manzi, are designed to simply hold the fastening strap in place.

Finally, the Publication No. US2002/0124433A1, to Pan, of Taiwan, defines a sports sandal having a sole provided with at least one through hole and two openings located therein. The at least one strap is provided with the placing strap to be put through said through hole of the sole, so that the placing tape can be attached or detached with said strap, apparently for varying the coloration or design of the sandal, as noted.

See also U.S. Pat. No. 6,606,803, U.S. Pat. No. 4,476,639, U.S. Pat. No. 4,860,464, U.S. Pat. No. 1,976,819, U.S. Pat. No. 5,379,529, U.S. Pat. No. 4,550,511, U.S. Pat. No. 2,539,761, U.S. Pat. No. 4,296,558, and U.S. Pat. No. 6,601,323, for related prior art. These are the prior art known to the applicant.

SUMMARY OF THE INVENTION

The present invention comprises a sandal or shoe having a vamp in the form of a loop. The loop is attached to the shoe by means of being disposed within a slot within the base of the shoe. The vamp further comprises different colors, or designs, texture, air ventilation, or means for support, massage, or stimulation of the underlying foot, along its circumference and on either side of the loop. Furthermore, the vamp may be rotated about the shoe, within the slot, in order to selectively expose the different colors of the vamp.

The vamp in the form of a loop may also be used in conjunction with a conventional vamp. In this manner, the loop serves a more decorative and not a functional purpose.

The vamp may also be attached in a loop with one seam comprising hook and loop material or other means of fastening. In this manner, the vamp may be removed from the shoe and reversed to expose colors or designs on the opposite side of the vamp.

Further, the vamp may be used with a shoe and placed within the shoe rather than outside the shoe. Holes provided in the shoe would expose the vamp to view.

DESCRIPTION OF THE PREFERRED EMBODIMENT

Figure 1:
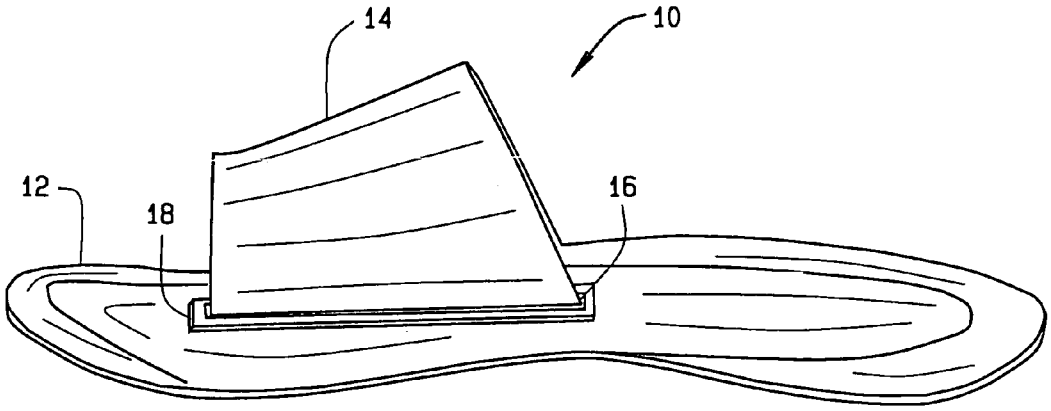
FIG. 1 is a side view of a sandal according to one embodiment of the present invention.
Figure 1A:
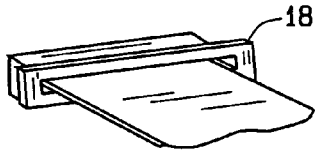
FIG. 1*a* is a partial view of the band holding flange as attached to the sole of the sandal.
Figure 1B:
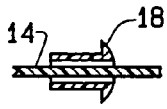
FIG. 1*b* is a sectional view taken through FIG. 1*a;*

Referring to FIG. 1, there is shown and described a sandal 10 having a sole portion 12 and a vamp portion 14. The sole portion 12 is a standard sole having a slot 16 cut therethrough. The slot 16 may optionally have a flange 18 at each end thereof. The vamp portion 14 may be inserted through the slot 16 and the flange 18 and sewn to form a loop. Optionally, rather than being sewn to form a loop, the hook and loop material may be attached to each end of the fabric to make the vamp portion 14 detachable from the shoe and to make the vamp portion 14 adjustable to wearer's foot. Moreover, the detachable vamp portion 14 may be reversible so that either side of the vamp portion is viewable, each side capable of being a different color or design. Regardless of whether the vamp portion 14 is sewn or incorporates hook and loop material, the vamp portion 14 is moveable within the sole portion 12 such that the vamp portion 14 may be rotated while attached to the shoe. As a result, if the vamp portion 14 comprises lengths of various colors and designs, the vamp portion 14 may be rotated to selectively expose the various colors and designs. FIG. 1*a* and FIG. 1*b* shows a side view of the flange 18 and how the vamp portion 14 and the flange 18 are interconnected.

Figure 2A:
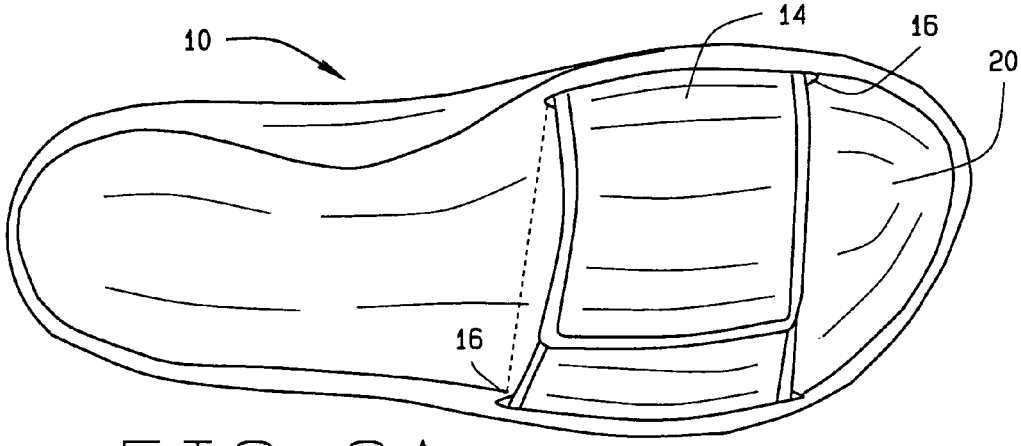
FIG. 2*a* is a top view of a sandal according to another embodiment of the present invention.
Figure 2B:
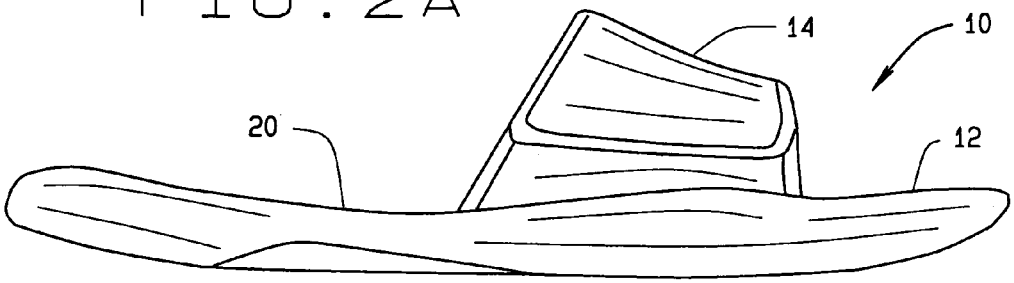
FIG. 2*b* is a side view of a sandal according to another embodiment of the present invention.

Referring to FIG. 2*a* and FIG. 2*b*, rather than having the slot terminate at opposite side portions of the shoe, as in FIG. 1, the present invention may incorporate a slot that terminates in a top portion 20 of the sandal.

Figure 3A:
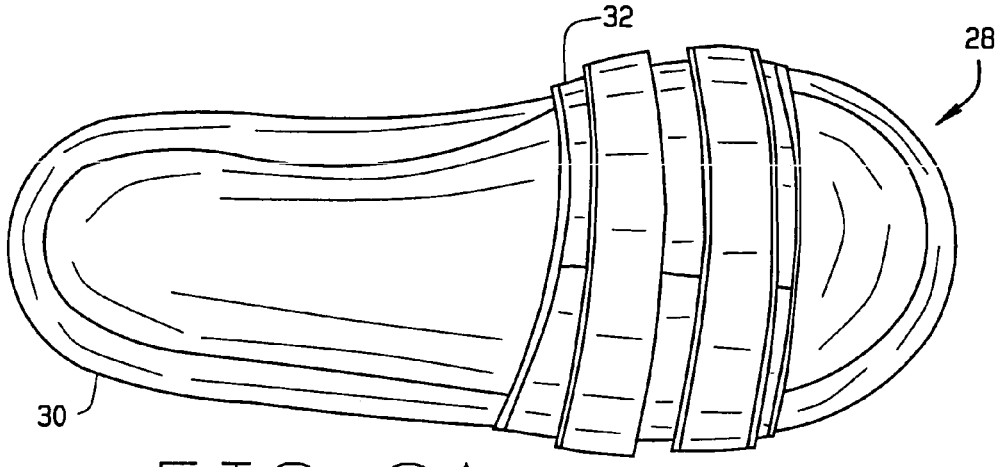
FIG. 3*a* is a top view of a sandal according to another embodiment of the present invention.
Figure 3B:
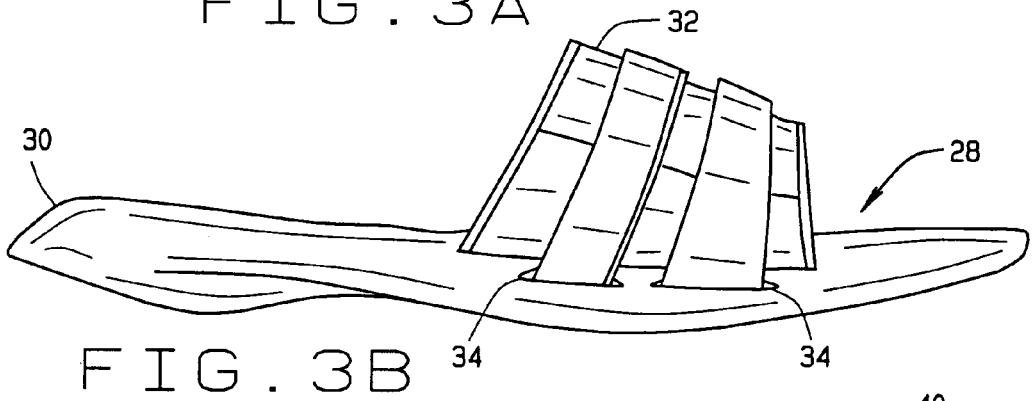
FIG. 3*b* is a side view of a sandal according to yet another embodiment of the present invention.

Referring to FIG. 3*a* and FIG. 3*b*, again there is shown a sandal 28 with a sole portion 30 and a vamp portion 32. The vamp portion 32 is a stationary vamp and may be adjustable, as is known in the prior art. The sole portion 28 further include one or more slots 34, as described with respect to FIG. 1, or FIG. 2*a* or 2*b*. Disposed within each slot(s) 16 is a decorative band 36. The decorative band 36 is preferably comprised of two or more lengths of material sewn to form a loop. Each length may have a different design or color associated therewith. Alternatively, the decorative bands may be attached by hook and loop material at one seam so that the bands 36 can be removed from the sandal, and the bands 36 may have different designs or colors on an opposite side so that the bands 36 can be reversed in order to expose a different color or design. Regardless the bands 36 may be rotated within the slots to expose a different color or design across the vamp 32 of the shoe 28.

Figure 4:
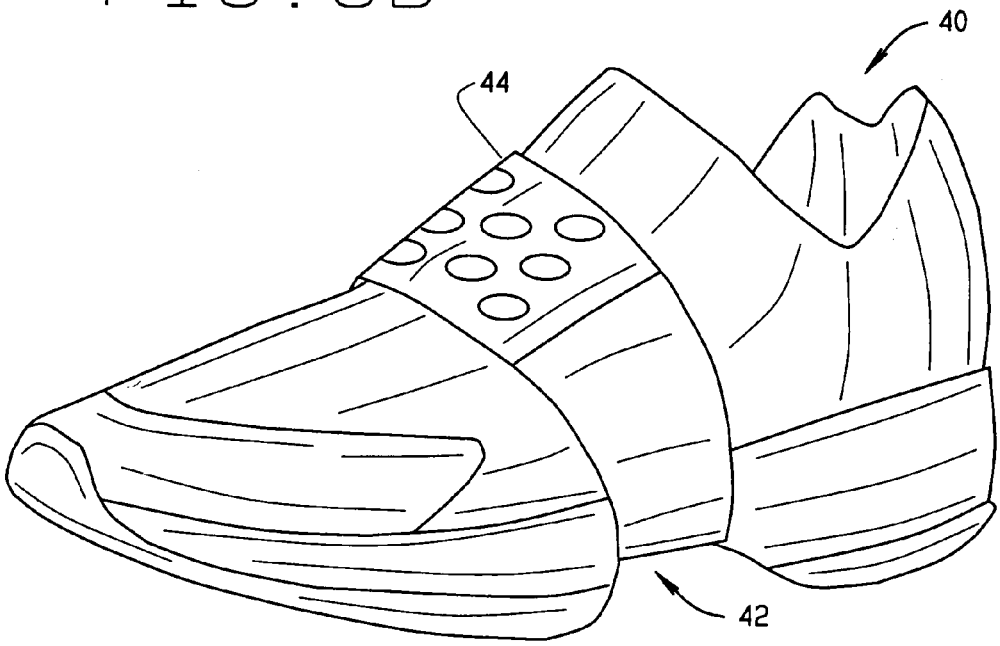
FIG. 4 is a perspective view of the shoe according the embodiment of the invention, with the vamp arranged outside of the shoe, and within a slot formed between the midsole and shoe sole.

Referring to FIG. 4, there shown the same concept as FIGS. 1–3*b* applied to a shoe 40 rather than a sandal. Shoe 40 comprises a prior art tennis shoe having a high mid-sole 42. Looping around the shoe is a decorative strap 44. The particular loop or rotable vamp 44 may extend around the outside of the shoe, as noted, and even be located within a groove provided through the underside between the midsole and shoe sole 42. The strap 44 may include one or more pieces of material sewn together to form a loop and have different color or designs along the circumference and on either side. The strap may be rotated in order to expose the different color or designs to view. While the strap 44 is shown going completely around the shoe 40, the concept of a slot through the sole of the shoe as with FIGS. 1–3*b* can also be implemented with the shoe 40.

Figure 5A:
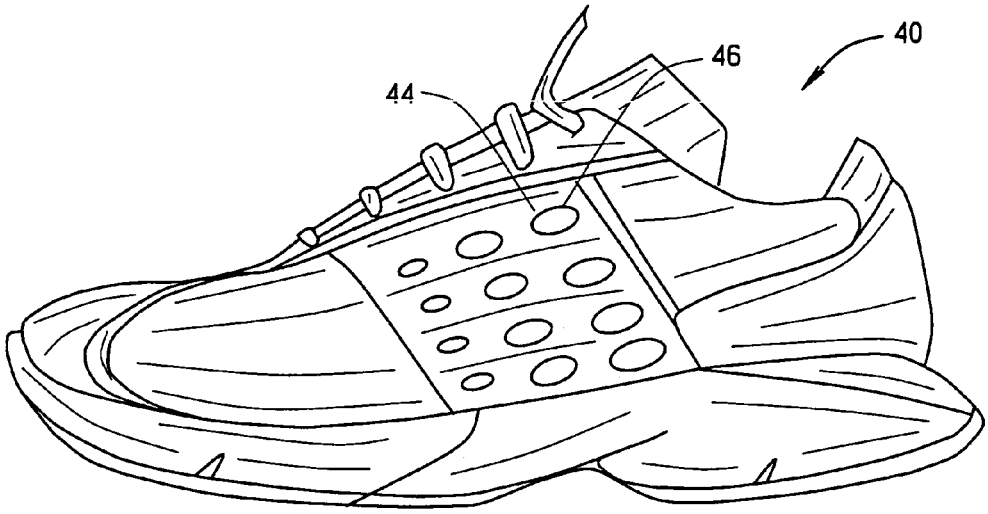
FIG. 5*a* is a side view of a shoe according to another embodiment of the present invention.
Figure 5B:
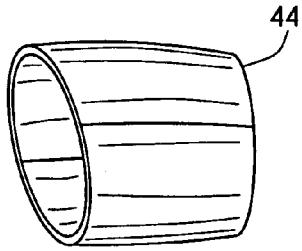
FIG. 5*b* is the vamp band used in the shoe in FIG. 5*a;*

Referring to FIG. 5*a*, the strap 44 of FIG. 4 may be provided through slots, as in FIGS. 1–3*b*, within the interior of the shoe 40 rather than the exterior of the shoe 40. The shoe 40 further defines holes 46 which allow the strap 44 to be viewed. As above, the strap 44 may incorporate hook and loop material, be reversible, and is rotatable within the slot.

Figure 6:
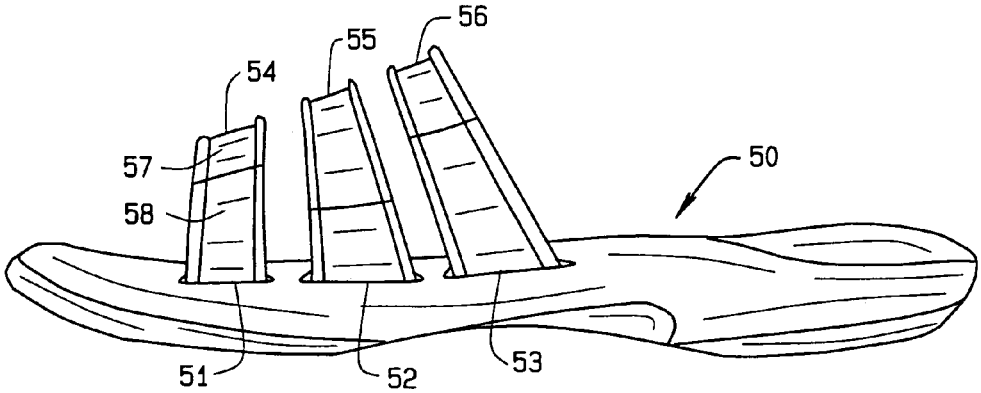
FIG. 6 is a side view of a shoe according to another embodiment of the present invention.

As can also be noted from the description of this invention, as shown in FIG. 6, the beach shoe or sandal 50 extends the full length of the foot of the wearer, and has a series of slots 51 through 53 provided through the sole, and through which a series of change-up vamps 54 through 56 extend, respectively. As can be noted, each of these change-up vamp or strap portions, as for example 54, may contain various integrally formed design or coloration changes, as can be noted from the distinction between portion 57 and portion 58 for the front strap 54, as can be seen. Thus, by revolving the strap 54 through its slot 51, various of the designs or coloration changes can be elevated for exposure at the top of the shoe, while the other portion of the coloration may be located, concealed, within the slot 51, depending upon that design for the strap the wearer wishes to disclose, for that day.

Figure 7:
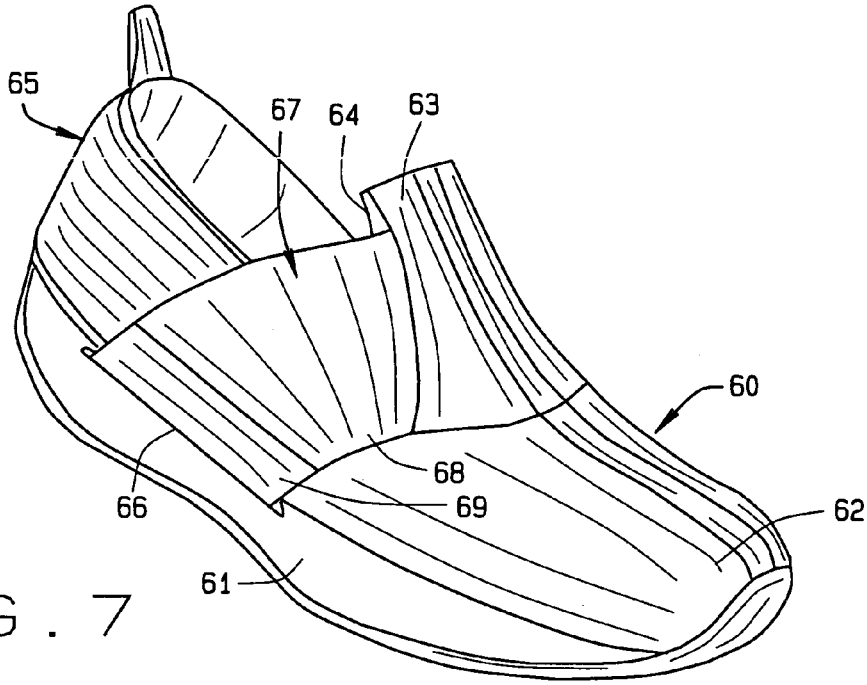
FIG. 7 is a perspective view of a slip-on type of athletic or casual footwear incorporating the subject of this invention.

FIG. 7 shows another variation for the change-up concept of this invention, for the athletic or casual slip-on shoe 60. As can be noted, this particular shoe includes the usual sole portion 61, and has an upper vamp 62, wherein the vamp extends upwardly were laces normally are located, but in this particular instance, furnishes an integral loop 63, having a clearance loop 64 provided therethrough. The back of the shoe includes the usual quarter and counter portions 65, as can be noted. Through the sole 61 is a slot 66, and it is through this portion of the sole, arranged within the slot, is the band 67 which is capable of being turned, to furnish either one coloration or design 68, as can be seen, or the color or design 69, as can also be noted. This band 67 extends through the loop 64, previously described, so as to integrate all of these operative components of the shoe together, to furnish a changeable aesthetic appearance to the footwear design, when worn, that allows the user to make whatever changes in the design or appearance of the shoe, simply by revolving the band, which forms a part of the vamp, 67 in place, by sliding it through the slot 66, during its manipulation and change over for variation in coloration, and the like.

Figure 8A:
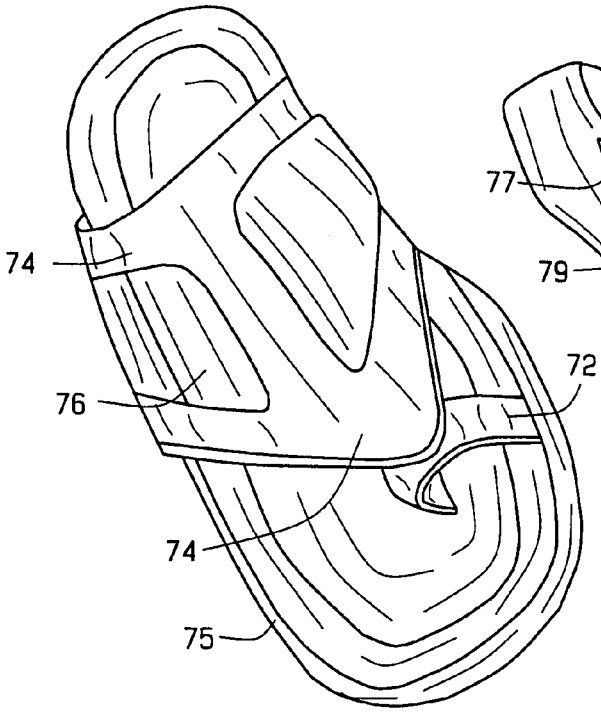
FIG. 8*a* and FIG. 8*b* show a plan and side view of a further embodiment for the footwear of this invention.
Figure 8B:
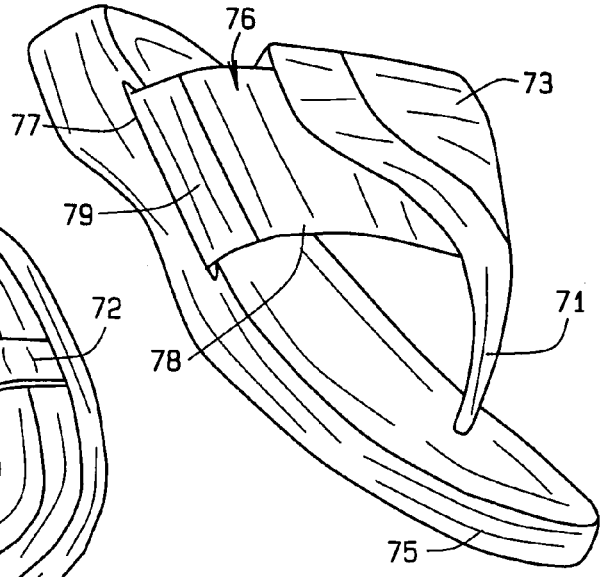

FIGS. 8*a* and 8*b* show another sandal or beach shoe 70, where once again, a thong type strap 71, or a toe retention loop 72 extend upwardly, and secure or integrally form the loop portion 73 or 74 which may be either cantilevered in their positioning, as can be seen in FIG. 8*b*, or connect to the sides of the sole 75 of the shown shoes. Then, a vamp band 76 extends through the integrally formed slot 77 provided laterally through each of the soles, as noted, and through which the bands 76 are originally applied, or inserted, for slideable movement or change-up. Thus, the band may be located for disclosing one coloration or design 78, or the alternative coloration 79, as can be understood. Thus, when the band 76 is changed, by sliding it through the slot 77, and which bands extend through the looped portion 73 or 74, various colorations provided upon the-band can be exposed, by sliding them out of the slotted sole, as can be understood, to afford different aesthetics both design or coloration-wise, for the shoe, as noted.

Figure 9A:
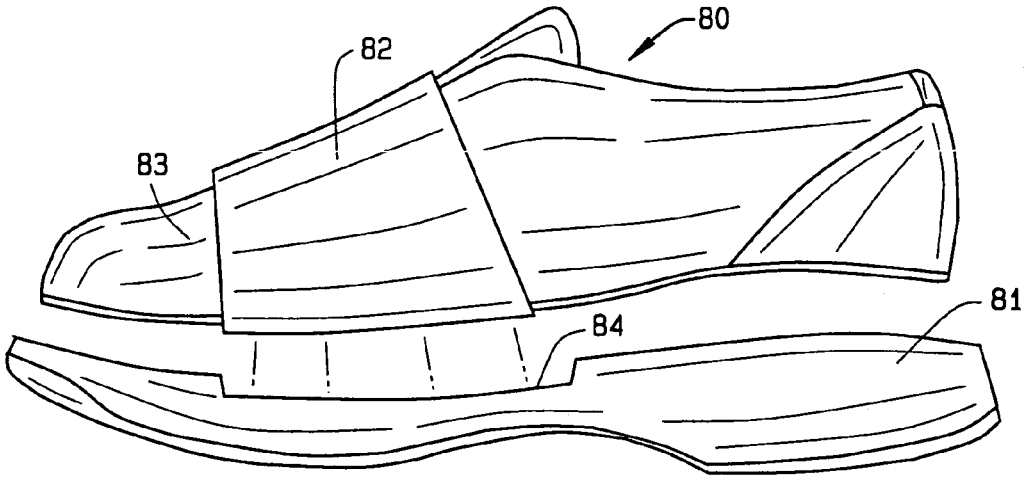
FIG. 9*a*, FIG. 9*b*, show a further embodiment, and the construction components, for connecting the sole to the lower part of the shoe upper incorporating the changeable vamp concept of this invention.
Figure 9B:
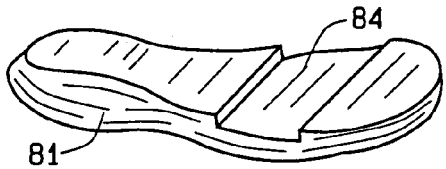

FIGS. 9*a*, 9*b*, show another type of shoe, whether it be the slip-on type, or other form of shoe, as can be noted. The shoe includes the shoe upper 80, of the usual design, and has a sole portion 81 that is adhered or otherwise stitched to the bottom of the shoe upper, when the footwear is assembled. But, in this particular instance, the change-up band 82 is provided, encircling the frontal upper part of the shoe vamp 83, and when the sole portion 81, with its integral slot 84 is secured to the bottom of the shoe upper, the vamp band 82 is retained in place, but because of the clearance provided by the slot 84, the band is capable of being revolved, or changed up, in its positioning, so as to furnish variations in the design or coloration for the shoe, due to the change-up of the vamp, when assembled, and manipulated, in the manner as explained herein.

Figure 10:
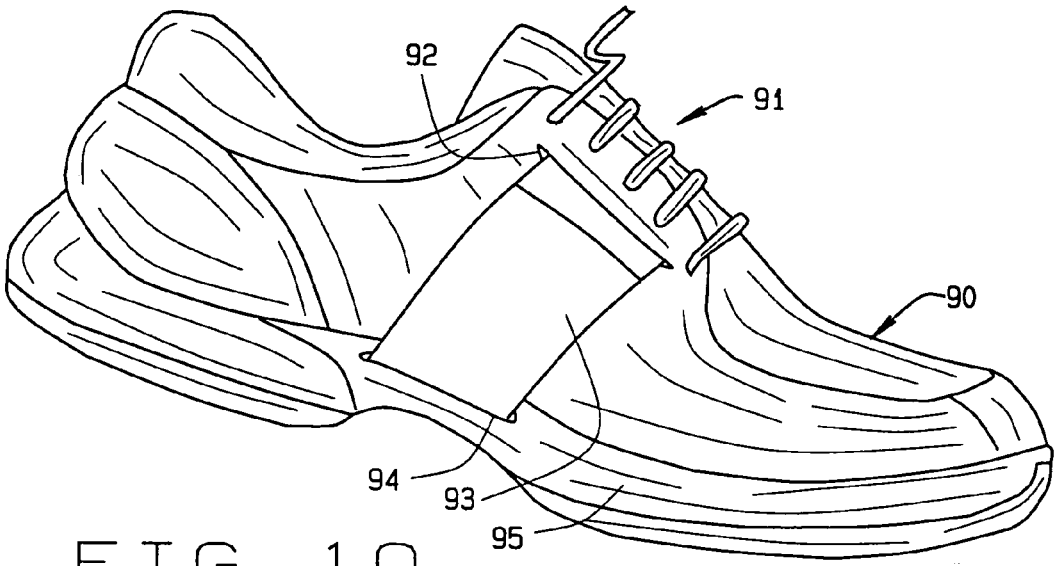
FIG. 10 shows another embodiment for the shoe of this invention having the changeable side portion for the footwear as noted.

FIG. 10 shows another type of footwear 90, whether it be an athletic shoe, casual shoe, walker, or the like. In this particular instance, the shoe vamp and lacing portion 91 provides a slot 92 through which the changeable band 93 inserts, under the lacing, but over the foot, and which band 93 can be revolved, by pulling it out of the slot 94 of the sole portion 95 for the shown shoe. The slot 94 extends all the way through the sole 95, as does the in placed band 93, but the band can be turned, to furnish variation in the coloration or design for the shoe, at this location, as can be understood.

Figure 11:
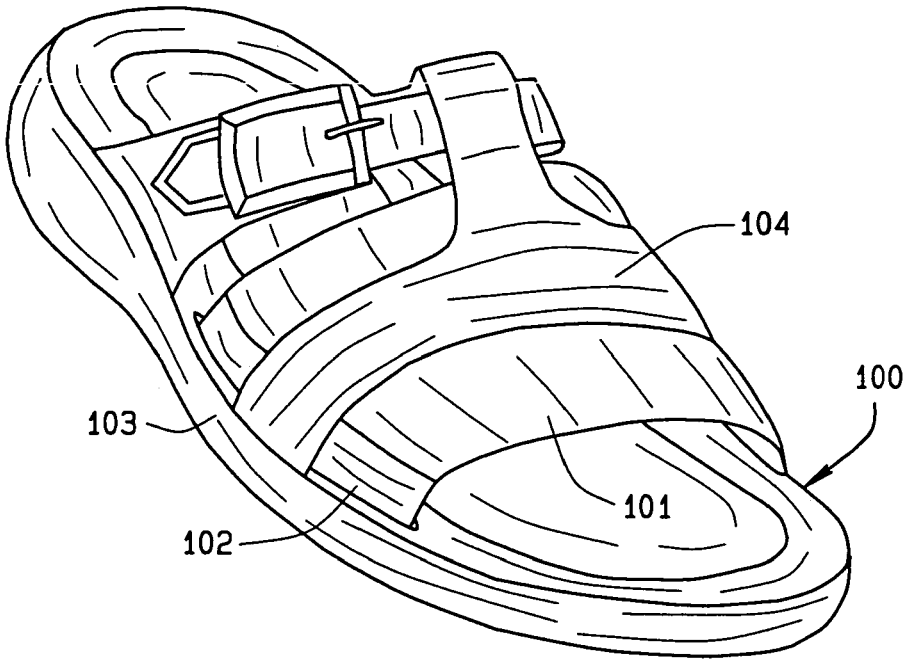
FIG. 11 shows a perspective view of a sandal, incorporating the change-up feature for the vamp of this particular invention.

FIG. 11 discloses a further variation upon a sandal or beach shoe 100. In this particular instance, the vamp formed band 101 extends through the slot 102 formed of the sole portion 103 for the sandal as disclosed. This vamp band 101 is generally arranged under the strapping 104 for the noted shoe structure. Once again, the vamp can be revolved, through the slot 102, of the shoe sole, so as to afford different coloration or design for the disclosed shoe, as can be further understood.

Figure 12:
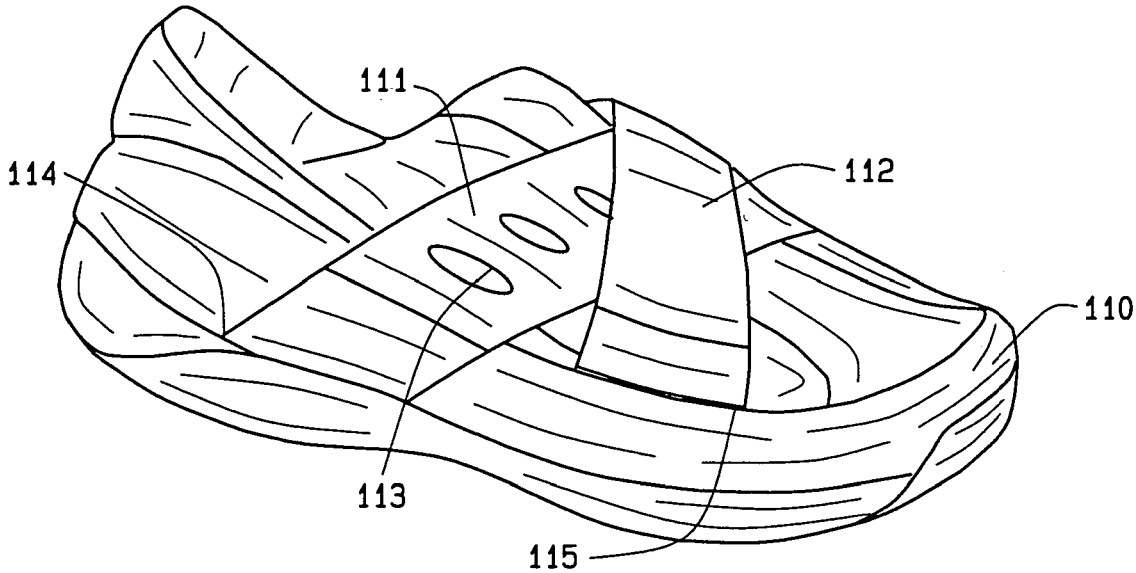
FIG. 12 is footwear with double straps that both cross and can be rotated.

FIG. 12 discloses a shoe, of the athletic, walking, or casual shoe 110, having a pair of double straps 111 and 112, that cross over the upper vamp, and which can be rotated, or changed up, to provide different coloration, or aeration or ventilation through the apertures 113, or the like. As noted, one of the straps, 111, passes through a slot, as at 114, whereas the second strap 112 may pass through a slot, as at 115, arranged across the interior of the upper part of the vamp.

Figure 13:
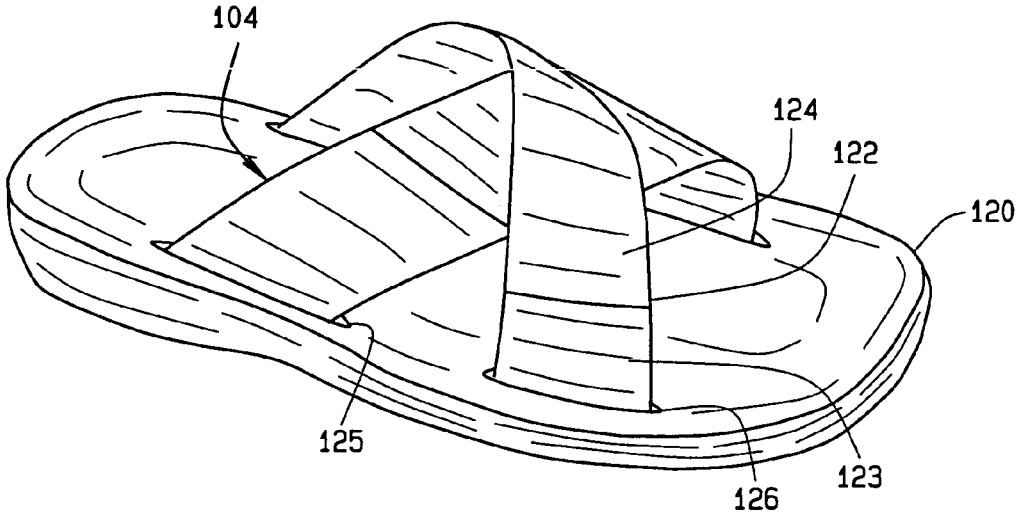
FIG. 13 shows a sandal with double straps that cross and each of which can be rotated.

FIG. 13 discloses a related type of sandal 120, wherein a pair of such straps 121 and 122 may have different colorations, as within the region of 123 and 124, and where both of the shown straps, or loops, insert through slots 125 and 126 furnished through the sandal sole, and which may be rotated, in order to provide multiple color exposures.

Figure 14:
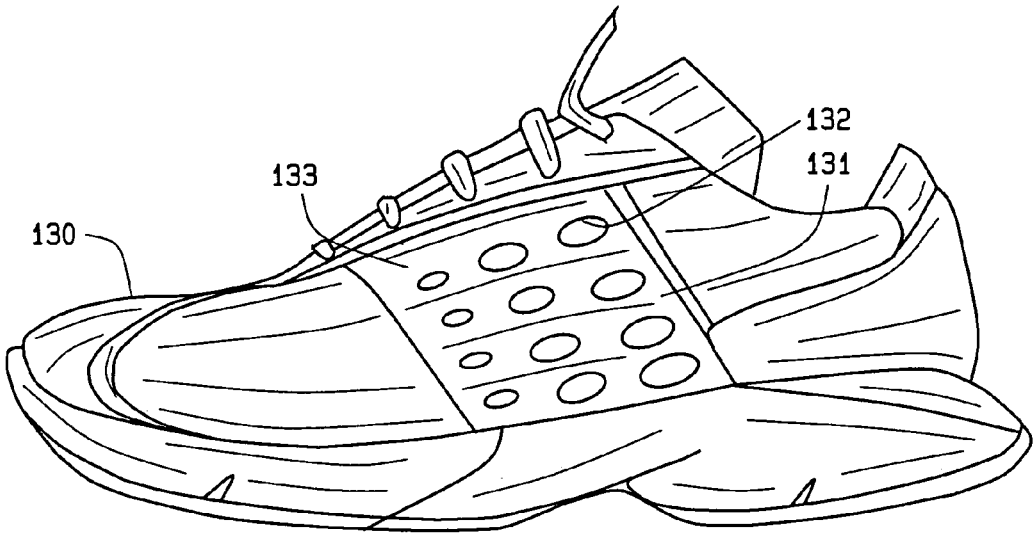
FIG. 14 shows a shoe that incorporates ventilation and which may be integrated into the structure of the rotatable vamp, as shown.

FIG. 14 shows a variation in a style of a shoe, as at 130, and which may have a side quarter portion, as at 131, which may contain various ventilation apertures, as at 132, and likewise, have different colorations upon its surface 133, and furthermore, such loop portion 131 can be rotated, so as to vary the ventilation, coloration, or other indicia provided upon its exterior surface.

Figure 15:
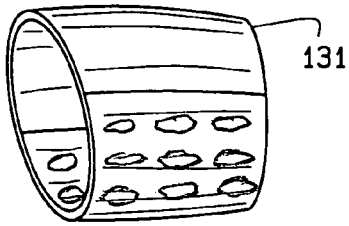
FIG. 15 shows the ventilated and rotatable vamp for the shoe as shown in FIG. 14.

FIG. 15 shows the Change Up style of loop 131 which may be used and installed in conjunction with the footwear 130, as shown in FIG. 14.

Figure 16:
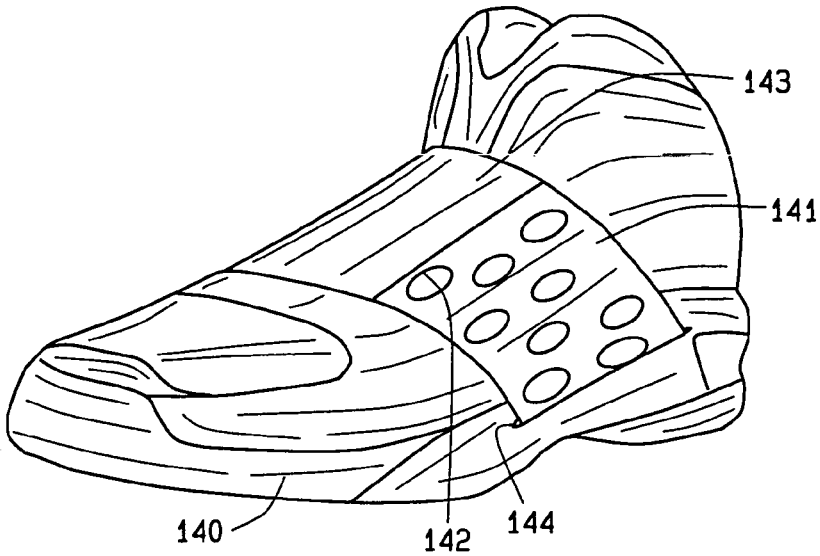
FIG. 16 shows a pair of the footwear having the ventilation means, and which also incorporates elasticity to furnish massage and stimulation to the foot.

FIG. 16 shows a slip-on type of shoe, as at 140, and a pair of such shoes is disclosed. In their structure, which is a Change Up loop 141, having aeration apertures 142 or different colorations 143 provided and integrated into the structure of the loop, and which may be rotated through the sole slot 144 as can be understood.

Figure 17:
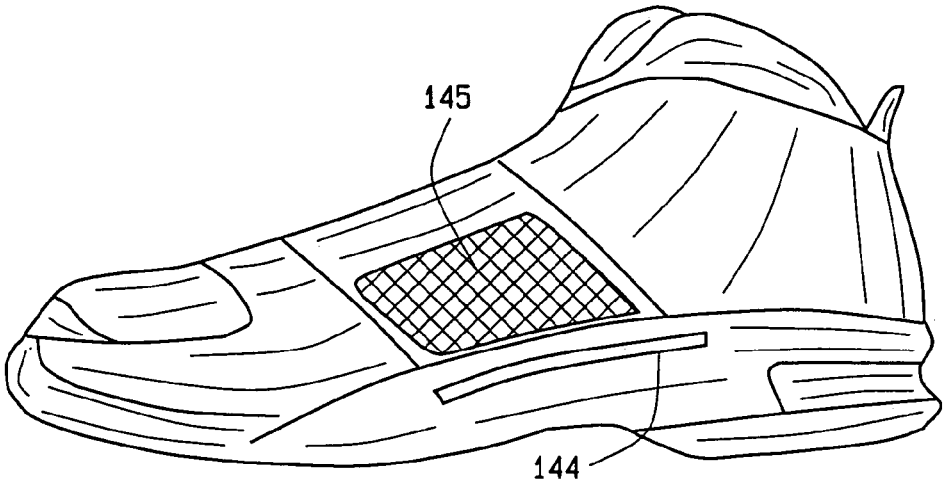
FIG. 17 discloses another form of footwear wherein the upper part of the vamp, laterally thereof, discloses ventilation means.

FIG. 17 shows how a ventilation mesh, as at 145, may be furnished through the frontal quarter portion of the shown shoe, before the type of loop 141, of FIG. 16, is applied thereover, for extension through the slot 144, as previously reviewed.

Figure 18:
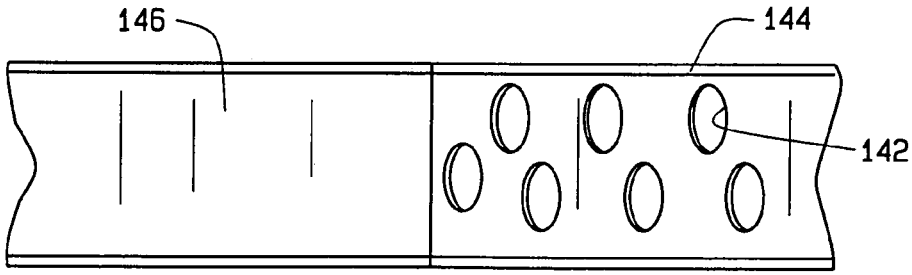
FIG. 18 shows how the loop strap, for the shoe as shown in FIG. 16, may contain both elasticity, and aeration apertures, continuously within its structure.
Figure 19:
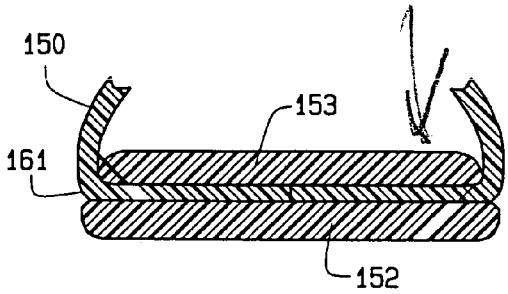
FIG. 19 shows a cross sectional of footwear disclosing how the loop extends through a slot provided within the sole at the mid sole region of the shoe.

FIG. 18 shows a segment of the loop 144, and how aeration apertures 142 may be provided within a portion of it, and how different colorations, or different textured material, such as resilient or elastic material, as at 146, may be provided upon another segment of the continuous loop. Then, that loop of material will extend through the slot 144, for being turned, as can be understood.

Figure 20:
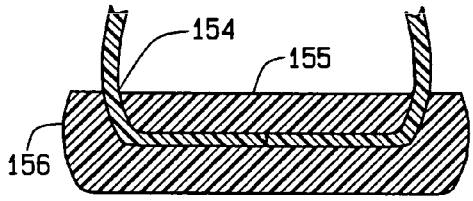
FIG. 20 shows how the loop can extend down through slots provided within the upper surface of the sole, in the mid sole region of the shoe, and then extend through a slot therein for rotation.
Figure 21:
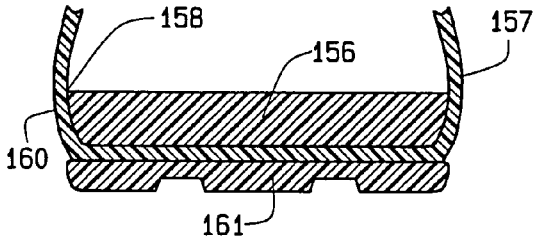
FIG. 21 discloses how the loop can extend between two segments of the shoe sole, at its mid sole region, to provide for rotation of its shown loop.
Figure 22:
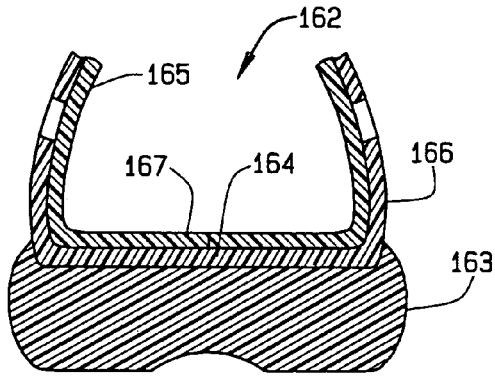
FIG. 22 shows how the loop means may extend under the sock liner provided within the shown footwear.
Figure 23:
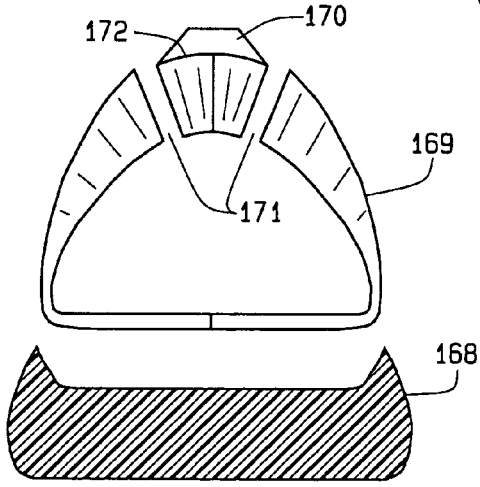
FIG. 23 shows how the rotatable loop can be provided externally around the upper of the shoe, and fits within a channel, generally at the mid sole region, arranged above the shown shoe sole.

As can be noted in FIGS. 19 through 23, various arrangements of the turnable loops can be provided through integrally formed slots at various locations generally along the mid sole of the cross sectional views of the disclosed footwear. For example, in FIG. 19, the loop 150 may extend through a slot 151 provided between the shoe sole 152 and the inner sole 153. Or, as can be seen in FIG. 20, the slot 154 may extend and open along the upper surface 155, of the shown sole 156, and therein provide an integrated slot through which the looped material may insert, and be turned, for changing either the characteristics or the coloration for the footwear, as worn. FIG. 21 shows how the looped material 157 may extend through a slot 158 arranged at the outer periphery of the shoe mid sole 159, just inside the footwear quarter portion 160 as can be noted. The shoe sole 161 will be adhered to the mid sole, and the remainder of the interior part of the mid sole, through the length of the shown shoe. FIG. 22 shows another variation for a shoe 162. In this particular instance, the shoe sole 163 furnishes a slot 164 through which the looped material 165 may extend. The outer surface of the shoe quarter portion 166 provides the formation of the slot, along with the sole 163, and the sock liner or interior of the shoe, as at 167, as can be noted. Finally, FIG. 23 shows a shoe sole 168, and the looped material 169, preferably for a sandal, and how a frontal part of the central vamp 170, for the sandal, may have integrated straps 171, which are looped in and of themselves, and through which the band of coloration material 172 extends, for rotating within the slot formed above the shoe or sandal sole 168, as noted.

Figure 24:
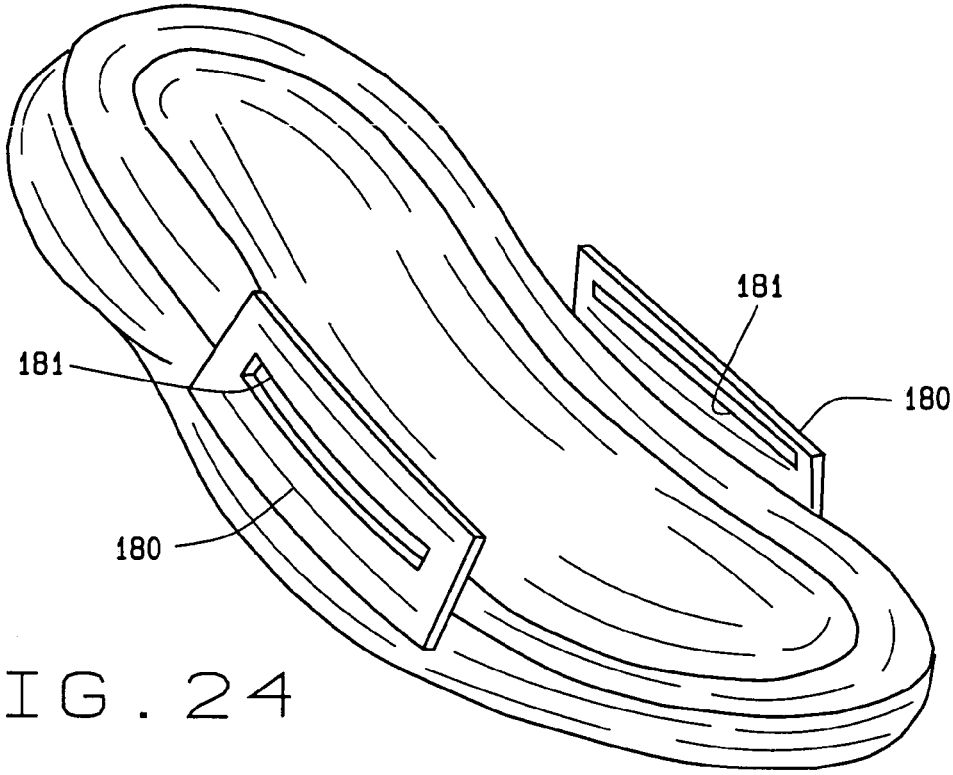
FIG. 24 shows a further modification to the sole of the shown footwear wherein flanges laterally of the sole support the changeable vamp straps of this invention.
Figure 25:
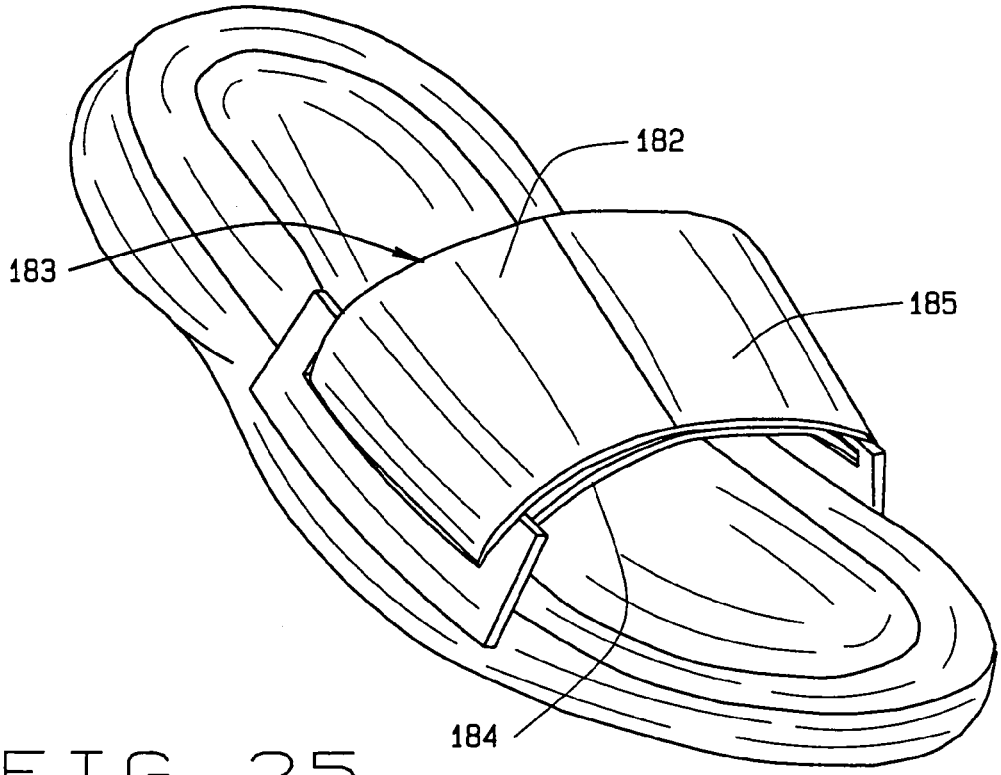
FIG. 25 discloses the arrangement of the vamp strap, or band, inserted through the sole flanges as disclosed.

Further modifications to the concept of this invention includes, as shown in FIG. 24, the application of upstanding flanges, as at 180, adhered to the sides of the sole of the shown shoe, sandal, clog, or the like, being applied thereto by means of an adhesive, stitching, molding, or any other means for rigid application. Each of these flanges includes an open slot, as at 181, which extends from front to back of the shown flange. Through these slots may be inserted the vamp strap or band 182, which may be slidingly rotated within the confines of its attachment with the shown sole flanges. In this configuration, the band would double back on itself rather than run underfoot. Thus, as can be further noted at 183, the band may have a configuration of different coloration, such as at one half or part thereof, as disclosed at 184, and another coloration, as at 185. Thus, when the band is applied in place, it may be slid through the slots to provide for a change of the coloration of said band, so as to vary the aesthetics and appearance of the footwear, during its usage and application. The band may even be twisted in place to change its aesthetics. The band may comprise a continuous loop, but which may be held at its ends together by means of Velcro or other forms of clasp or attachment, so that, initially, it may be opened and slid through the slots 181, and then closed to form its continuous loop configuration, and function in the manner as described, when applied by the user. The band can also be twisted and reversed to further change its appearance. Various other indicia, designs, colorations, or multiple colorations can be applied preferably to the external surface of the continuous band, so that the band may be slid through its various flanges, to provide for changing of its exposed coloration, at least upon the upper side of the band, as shown in FIG. 25, to add to the aesthetics of the footwear, when worn.

Figure 26:
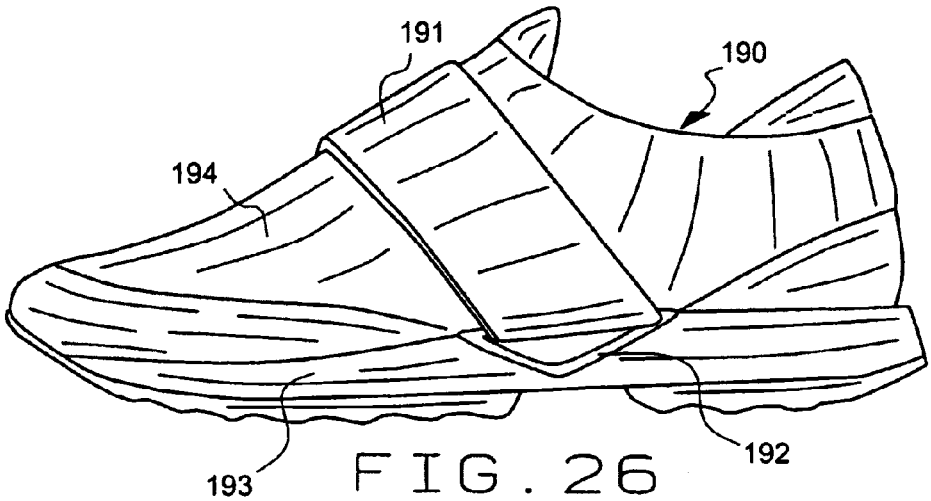
FIG. 26 is a side view of the shoe showing the rotatable loop extending through a D-ring or related loop provided at the upper side edges for the shoe sole at the mid sole region.

FIG. 26 discloses a slip-on footwear 190 that incorporates a rotatable loop 91, and which extends down to either side of the shown shoe, to be applied through a slot, or D-ring, or related structure, as noted at 192, which is integrally formed or connected to the upper edge of the shown sole 193 of the disclosed shoe. Actually, the rotatable loop can be a continuous loop, either arranged through the sole, or doubled back upon itself over the top of the vamp 194 of the shown shoe. In addition to allow for application of the loop, or for its replacement, the loop may be a length of strap, that may have connecting means, such as Velcro, or loop and pile connection means, applied at its ends, connecting in the manner as previously described for the type of strap as shown and described in FIG. 18.

Figure 27:
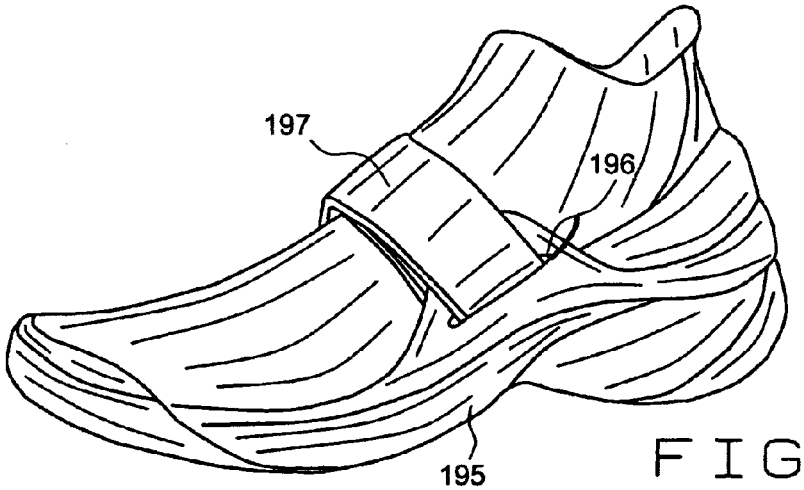
FIG. 27 shows an extension of the sole, extending upwardly, having slots therethrough, and through which the rotatable loop of this invention may be applied.

FIG. 27 shows further variation upon the style of the rotatable loop as described in FIG. 26, and in this particular instance, the sole 195 provides an integrally molded upwardly extension 196, provided to either side, and through which the rotatable loop 197 of the type as previously described, can be inserted and applied. In this particular embodiment the loop may hold back on itself.

Figure 28:
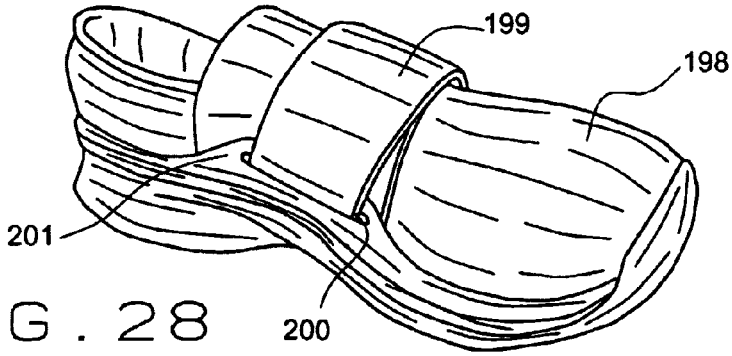
FIG. 28 is a further variation upon the structure of the shoe, as from the opposite side, as noted in FIG. 27.

FIG. 28 shows a further variation of the opposite side for footwear 198, where the rotatable loop 199 is applied through the shown slots 200 formed integrally of the upper lateral edges 201 of the shown slip-on shoe.

Figure 29:
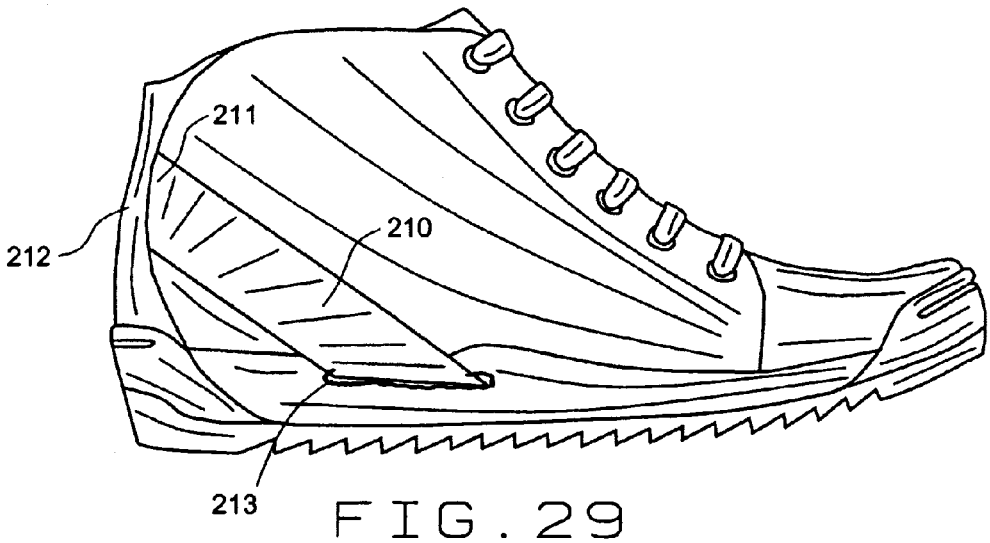
FIG. 29 discloses how the rotatable loop can extend around the back or counter of the shoe or through a slot therein, and extend through a slot provided on the heel part of the shown shoe.
Figure 30:
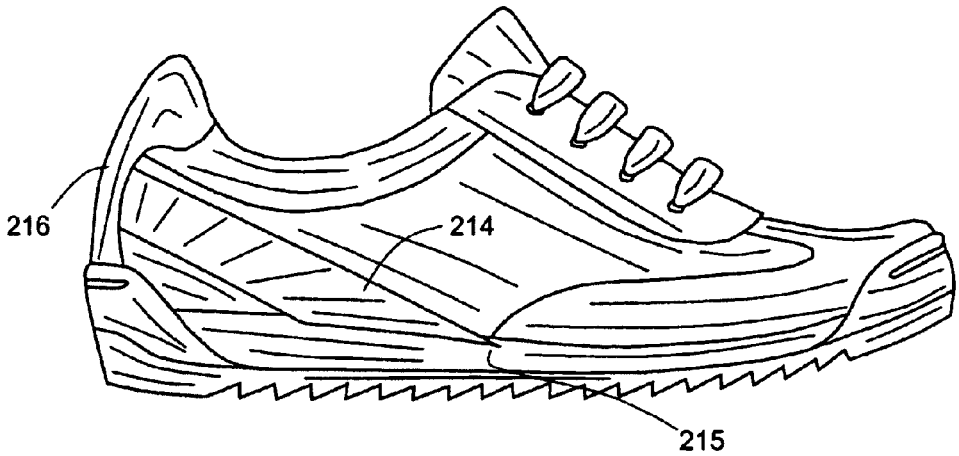
FIG. 30 discloses a related type of rotatable loop, as shown in FIG. 29, for a low cut athletic shoe.

FIG. 29 shows a further variation upon the use of a rotatable loop or strap 210 of this invention. In this particular instance, the upper back edge of the loop, as at 211, can insert underneath of the counter 212, or through a slot formed therein, and in addition, extends at its opposite end through the slot 213 formed through the proximate upper heel portion for the shown high top athletic shoe. In addition, FIG. 30 shows how a related type of rotatable loop 214 can insert through a slot 215, within the proximate same location for the shown low cut athletic shoe, and then extend around the proximate counter 216 of the described shoe. The back end of the loop can insert either through a slot within a counter, or perhaps even pass through any type of ringed connection formed externally and rearwardly of the shown counter, to position that part of the rotatable loop fixedly in place, but yet allow for the loop to be rotated, so as to expose and disclose different colorations, designs or emblems, and as can be understood from the concept of this invention.

Figure 31:
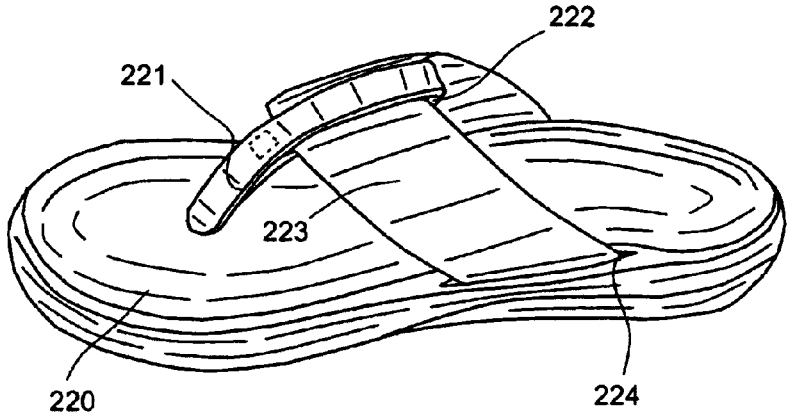
FIG. 31 discloses a variation upon a sandal, such as a thong or flip-flop, wherein the rotatable loop extends through a rearward part of the sole, or under its sock liner, as previously reviewed, and then extends up through the loop provided for the toe strap for the shown shoe.

FIG. 31 shows a further variation upon a sandal, as at 220, and which may comprise a thong or flip flop style of shoe. In this particular instance, the usual style of toe strap 221 connects with or through the sole, at its frontal portion, and which usually inserts between select toes of the shoe wearer. This particular toe strap has a loop formed within a structure as can be noted at 222, the rotatable loop style of means as explained for this invention, as shown at 223, inserts through the toe strap loop, as at 222, and also extends down through some form of slot, as at 224, or even a D or other style of holding ring, one provided to either side of the rearward portion of the sandal sole, to allow for the loop to be rotated therein, to expose different colorations, as desired.

Figure 32:
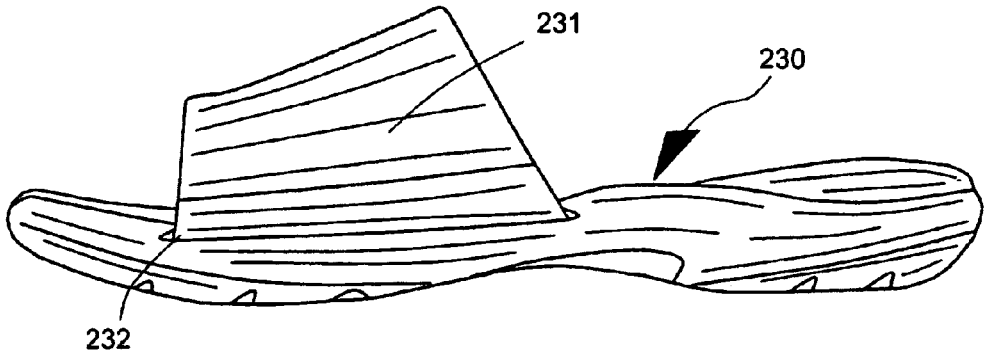
FIG. 32 provides a rotatable loop that extends through the sole of the shown sandal, and can be rotated therein to vary the aesthetics and colorations.

FIG. 32 shows another type of sandal, as at 230, which has a vamp located type of rotatable loop 231 can be rotated therein, while the loop strap extends out of the shown slot 232 provided to either lateral side of the shown sandal sole.

Figure 33:
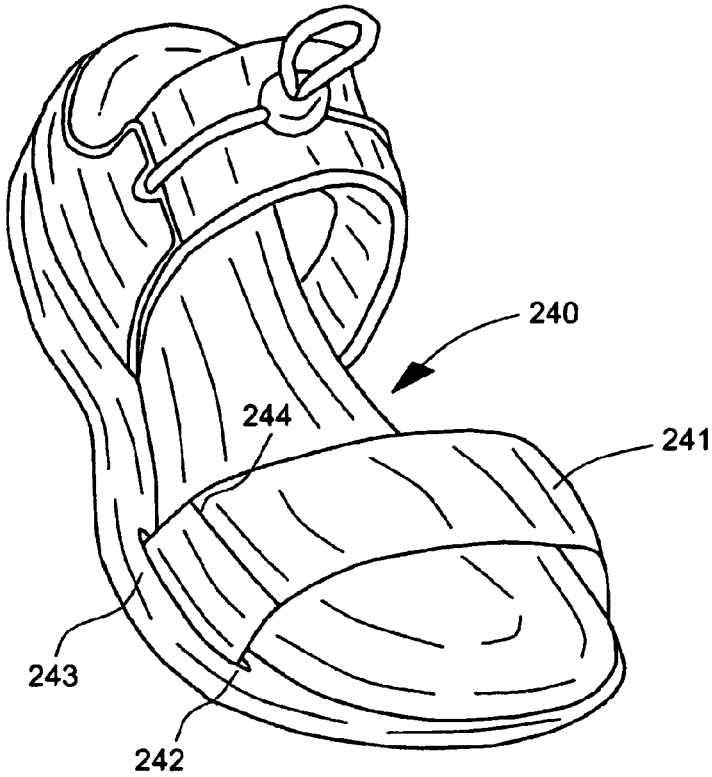
FIG. 33 discloses another form of a sandal having a continuous rotatable loop provided through the frontal part of its sole.

A further variation upon this invention is shown in FIG. 33. This particular sandal 240 contains the style of rotatable loop 241 as previously explained. In addition, the rotatable loop extends through the formed integral slots, as at 242, that extends through and opens at either side of the shown shoe sole 243, and this particular loop can be rotated, so as to expose different coloration. In addition, as noted, it may be separated, along its edges 244, being held together by Velcro or other style of fastener, so as to be removed, and replaced, by a loop that may be fabricated of differing coloration, design, or aesthetics.

Figure 34:
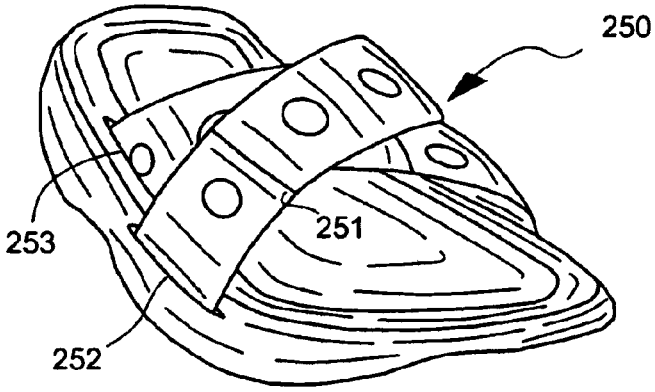
FIG. 34 discloses a double strap that extends through a pair of integrally formed slots furnished within the sole of the shown sandal.

FIG. 34 shows another type of continuous rotatable loop, as at 250, and which may be continuous, although it may be separated, along its edge 251, for removal and replacement. Nevertheless, it should be noted that there are a pair of slots integrally formed through the sandal sole, as at 252, 253, and the rotatable loop may be formed of a single length of strap, and inserted continuously through the pair of slots, as a single rotatable loop, and fastened together by Velcro, or other means of fastening, as along its edge 151, once the entire loop has been assembled.

Figure 35:
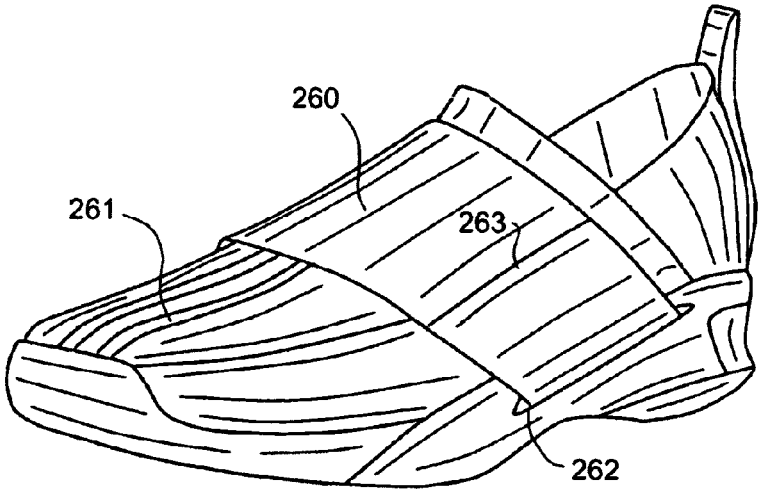
FIG. 35 shows a rotatable loop extending through slots provided at the upper edge to either side of the rear sole of the shown slip-on footwear.

FIG. 35 shows a further variation upon a rotatable loop for footwear upon this invention. In this instance, the rotatable loop 260 fits over the vamp 261 of the shown slip-oh shoe, and then extends down through a slot 62 provided to either side of the upper rear sole, or heel portion, of the shown slip-on. In this instance, the rotatable loop could be formed of an elasticized material to function as a fit and support element. Slot 262 may either be located along an upper extending edge of the shown sole, or it may extend all the way through the sole to open at its other side, as by providing such a slot under the sock liner, through the sole, or by other means for allowing these loops to pass therethrough, freely, particularly when the loop is desired to be changed, to bring an inserted portion for exposure upwardly, of the shoe, to display a different coloration or design. Again, the loop may be of a replaceable type, being separated along its edges 263.

Figure 36:
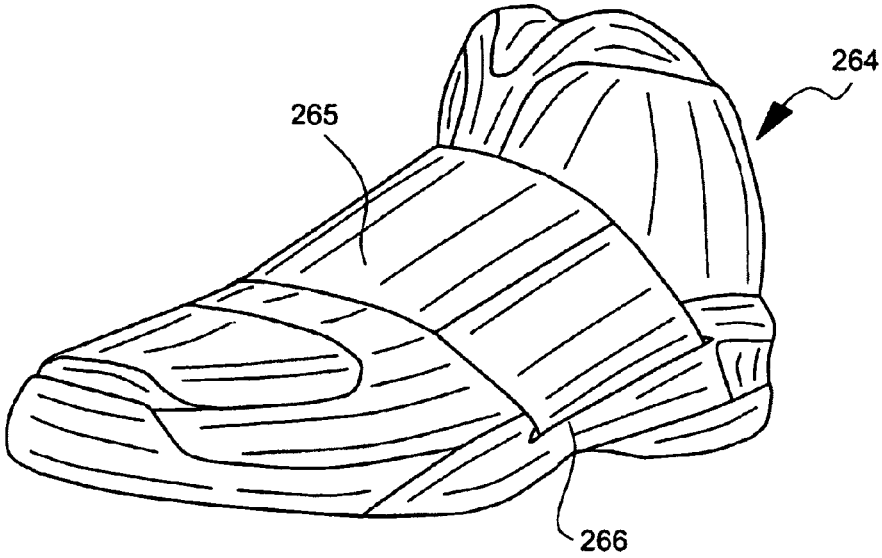
FIG. 36 shows another variation upon a rotateably loop within a slip-on footwear.

FIG. 36 shows a related structure for a slip-on shoe, as at 264 wherein the rotatable loop 265 may insert, once again, through the shown integral slot 266 provided at or through the rear sole of the shown shoe. The loop may also function as a support at the sole location.

Figure 37:
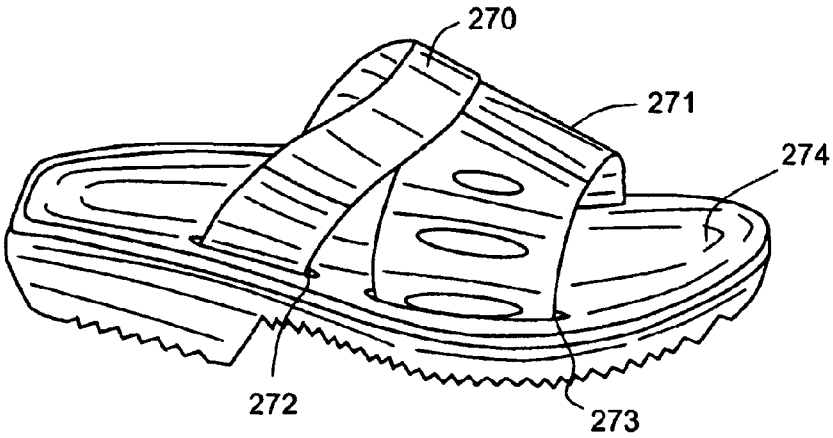
FIG. 37 shows a further variation upon a double rotatable loop that extends through the sole of the shown sandal.

FIG. 37 shows how a pair of rotatable loops, as at 270 and 271 can insert through their respective slots 272 and 273, formed through the upper surface of the shown sandal sole 274, or they may insert through slots that open along the lateral edges of the sole, as can be understood. Nevertheless, this provides a pair of rotatable loops that can be turned, or changed up, so as to expose different aesthetics for the footwear, when worn.

Figure 38:
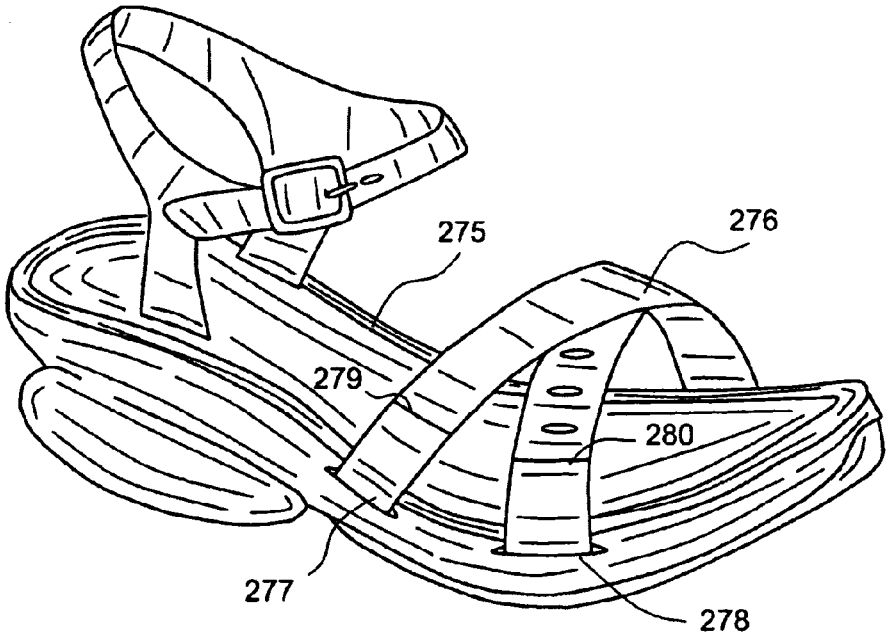
FIG. 38 shows a double rotatable loop extending through the arranged slots of the shown sandal.

FIG. 38 discloses another style of sandal, as at 275, wherein the continuous rotatable loop 276 may extend through a pair of slots 277 and 278 and can be rotated therein, when it is desired to change its design. Or, the loop can be separated, along its edges 279 and 280, when it may be desired to remove the strap, and replace it with another. Or, the rotatable loop 276 may be formed of a pair of straps that cross over each other, as can be noted, at their upper edges, as can be understood.

Figure 39:
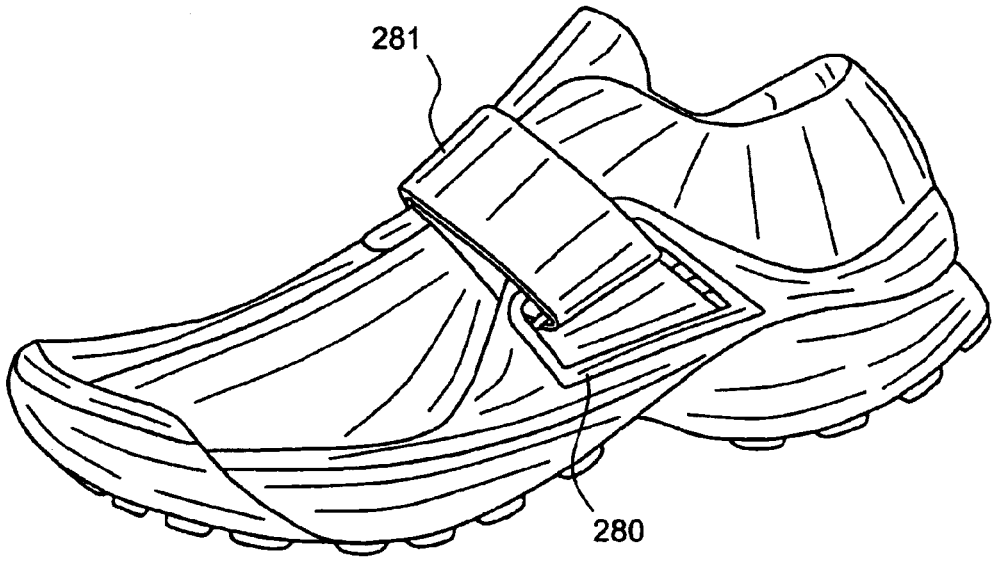
FIG. 39 shows the use of a D-ring, or related type of holder, applied to the upper side of the shown sole, and retaining the retainable loop therein, as shown upon a slip-on shoe.

Finally, FIG. 39 shows the use of a D-ring, either stationary or adjustable, as at 280, provided to either side of the shoe, or affixed to its upper edge of the shown sole, or be connected where the shoe upper attaches to the shoe sole, and in that position, having such a ring provided to either side of the shoe, as they are in place for accommodating the insertion of a continuous rotatable loop 281 inserted there through, and which loop can be pulled, to change its orientation, so as to disclose different coloration or aesthetics, as contemplated for the subject mater of this invention.

It must be understood, from reviewing the subject matter of this invention, that the strap or rotatable loop may be removable, or it may be continuous, but the concept is to provide for its ability to be changed up, when it is desired to display a different coloration, design, or aesthetics, on the upper surface of the shoe, and down along its side, where the rotatable loop may connect with connecting means, such as the D-rings, or extend through a slot formed within the sole, as previously reviewed. In addition, it may be likely that this type of a continuous loop may be provided internally of the shoe, and be exposed through its lacing eyelets, or the tongue opening, or ride over or through the tongue, so as to provide a form of coloration at that location, but yet the continuous loop can extend down into slots, along either internal side of the shoe upper, through the sole, or under its sock liner, but yet be freely turned therein, to disclose different colorations upwardly of the shoe, as it is being worn for any event, for walking, style, or athletic participation. In the same manner, where the rotatable loop may be provided internally of the shoe, and where its edges may be held or fastened by Velcro, it is further likely that such ends of the loop can be tightly connected, to bind upon the upper instep of the shoe, and thereby provide and form support for the shoe, when worn. Such type of a rotatable loop may be formed of a more elastic type of material, so as to furnish reasonable and resilient support, for the foot, when this rotatable loop is used internally of the shoe, such as in an athletic shoe, for supporting the foot of the wearer. These are examples of how the rotatable loop of this invention can have other attributes, during its or their usage, when embodied within the various styles of footwear, as explained herein.

The concept of this invention should be readily apparent from review of the various structures as provided herein. Essentially, it is to furnish means for changing the coloration, design, or other aesthetic characteristics for the shoe, by revolving a continuous band, in place, either through the sole structure of the shoe, and within various looped characteristics of the shoe upper, all of which integrate the band into the shoe structure, as assembled, or the band may double back on itself. Then, simply revolving the band provides for a variation in the coloration for the shown shoes that may add to the pleasing appearance, or other features for the shoe, as the owner may desire. For example, such a feature may be highly desirable for displaying, as for example, school colors, fashionable colors, mascot or school names, or other designs that may add to the aesthetics and style of the footwear, as the owner may desire.

Such variations or modifications, if within the concept of the development as shown herein are intended to be encompassed within the scope of the invention as explained. The specific depictions of the invention as shown in the drawings, and as explained in the specification, are provided for illustrative purposes only.

What is claimed is:

1. Footwear having a rotatable strap which can be shifted for display of different aesthetics, coloration, and the like, including a shoe sole, said shoe sole having a slot integrally provided therethrough, said shoe sole having side edges, and said slot opening proximate each side edge of the shoe sole, a strap provided through the slot and extending above the shoe sole to provide for embracing the foot upper, said strap being of uniform width throughout its length to provide for shifting of the entire strap through the sole to provide for a change in the aesthetics or coloration of the strap being shown, flanged inserts provided for inserting within the lateral openings of the sole slot, with the insert flanges maintained exteriorly of each slot, to provide for the guidance for the insertion and turning of the strap through the footwear sole, during its changing.

2. The footwear of claim 1 wherein said strap is provided with ends, said ends being secured together by fastening means.

3. The footwear of claim 2 wherein the fastening means comprising as a hook and pile fastening means.

4. The footwear of claim 2 wherein the fastening means comprises at least one clasp.

5. The footwear of claim 1 wherein footwear comprises a sandal.

* * * * *